US008162509B2

(12) United States Patent
Mackin et al.

(10) Patent No.: US 8,162,509 B2
(45) Date of Patent: Apr. 24, 2012

(54) HIGH INTENSITY LIGHT FIXTURE FOR USE IN HAZARDOUS LOCATIONS

(75) Inventors: Michael P Mackin, Chicago, IL (US); Derrick Titus, Buffalo Grove, IL (US)

(73) Assignee: Woodhead Industries, Inc., Lincolnshire, IL (US)

( * ) Notice: Subject to any disclaimer, the term of this patent is extended or adjusted under 35 U.S.C. 154(b) by 451 days.

(21) Appl. No.: 12/339,617

(22) Filed: Dec. 19, 2008

(65) Prior Publication Data

US 2009/0161352 A1 Jun. 25, 2009

Related U.S. Application Data

(60) Provisional application No. 61/015,892, filed on Dec. 21, 2007.

(51) Int. Cl.
*F21V 31/03* (2006.01)
*F21V 15/02* (2006.01)

(52) U.S. Cl. ..... 362/267; 362/362; 362/376

(58) Field of Classification Search ..... 362/33, 362/362, 267, 376, 263, 310, 414
See application file for complete search history.

(56) References Cited

U.S. PATENT DOCUMENTS

| | | | | | |
|---|---|---|---|---|---|
| 2,702,849 | A * | 2/1955 | Bissell | 362/267 |
| 2,786,936 | A * | 3/1957 | Appleton | 362/363 |
| 4,142,179 | A * | 2/1979 | Lowndes | 340/321 |
| 4,385,257 | A * | 5/1983 | Fitzgerald | 313/318.11 |
| 4,425,609 | A * | 1/1984 | Grindle | 362/373 |
| 4,489,367 | A * | 12/1984 | Herron et al. | 362/311.09 |
| 2009/0135607 | A1 * | 5/2009 | Holloway | 362/362 |

* cited by examiner

*Primary Examiner* — Peggy A. Neils
(74) *Attorney, Agent, or Firm* — Larry I. Golden

(57) ABSTRACT

An industrial lamp fixture employing a high intensity lamp and suitable for use in a hazardous location or atmosphere includes a system for replacing the lamp without having to disassemble the front framework which protects the glass lens and prevents it from breaking or cracking. The fixture includes a shell having a boss extending from the shell along the direction of an elongated lampholder when placed in the operating position. The lampholder is easily removed through the boss, by hand, thereby permitting and facilitating lamp replacement without disassembly of the protective grid or lens. A tongue-in-groove arrangement both aligns the lampholder to insure proper forward orientation of the lamp in use, and fixes the position of the lamp laterally relative to the shell.

7 Claims, 4 Drawing Sheets

HIGH INTENSITY LIGHT FIXTURE FOR USE IN HAZARDOUS LOCATIONS

RELATED APPLICATIONS

The present application claims the benefit of co-pending U.S. Provisional Patent Application No. 61/015,892 filed Dec. 21, 2007, entitled "High Intensity Light Fixture for Use in Hazardous Locations".

BACKGROUND OF THE INVENTION

The National Electrical Code (NEC) defines the requirements for the design and construction of electrical devices (e.g., light fixtures) intended for use in "hazardous locations" or "hazardous atmospheres"—terms defined in the NEC. Briefly, hazardous locations or hazardous atmospheres are defined by the conditions or substances present in the area, such as gas or vapor, dust or flyings (e.g., sawdust).

It is desirable to provide commercial light fixtures which use high intensity (e.g., halogen) light sources because of the greater amount of light they deliver efficiently. However, halogen lamps are known to operate at higher temperatures than, for example, conventional incandescent lamps. Halogen lamps provide much more light per unit of energy and typically have a much longer useful life than conventional light sources.

Typical light fixtures employing halogen lamps available at retail do not comply with the requirements of Class I, Division 1, Group C for devices operating in hazardous atmospheres. Any light fixture or lighting system which does not comply with the requirements of Class I, Division 1, Group C of the NEC may not be used in hazardous atmospheres.

In order to comply with the requirements of the NEC for operation in hazardous atmospheres, lighting systems must have an enclosure which meets certain requirements for thermal conductivity and strength—in general, the enclosure must be strong enough to contain an explosion within the device. That is, the walls must be thick enough to withstand the internal strain in the event of an internal (i.e., within the light fixture) explosion. Further, provisions must be made in the event the gas invades the enclosure and ignites within the fixture, that the flame does not escape from the fixture and ignite combustible gases in the ambient atmosphere. Moreover, the lighting system as a whole (that is, not necessarily the light source standing alone) must function at a temperature well below the ignition temperature of the surrounding atmosphere. This requires provisions for efficient transfer of considerable heat to the surrounding atmosphere.

A lighting system must also provide a means for any burning gases (in the event they should exist within the lamp) to escape from the lamp assembly because they may expand after ignition and thus create a risk of external explosion. However, the gases may be introduced to the ambient atmosphere only after they have been cooled and any possible flames "quenched". This escape route for exploding gases is typically provided through a "flame path". One type of qualifying quenching flame path, though not necessarily the only type of flame path, is known as the "ground surface" (i.e., machined surface) flame path. In this type of escape structure, two opposing surfaces (typically metal) are finished or ground and mated in facing configuration. The gap of the flame path must be uniform and within prescribed tolerances; and the length of the flame path and separation of the ground surfaces are also defined to insure flame quenching. This type of flame path permits gases to escape from the enclosure, but only after they have been sufficiently cooled following combustion so that they do not ignite any volatile gases in the surrounding atmosphere. Another type of quenching flame path is known as the threaded joint flame path, and this simply uses a threaded connection which permits expanding gases to escape around threaded shafts and the like to quench flame. In summary, finishing tolerances, length and separation are specified to insure that any burning gases are quenched before they are admitted into the surrounding atmosphere to avoid igniting any combustible gasses in the surrounding atmosphere.

One difficulty in using halogen lamps as the light source in a light fixture of this type is that some provision must be made for replacing the halogen lamp. In a light fixture designed for use in a hazardous location, many of the design considerations which might facilitate relamping the device, mitigate against the safety requirements for use in hazardous locations. In other words, if one had to dismantle the light fixture entirely, for example, by removing the lens from the lamp assembly in order to replace the lamp, it would be necessary to disassemble the lens from the lamp assembly. Because of the requirements of light fixtures designed for use in hazardous locations, such a design necessarily provides disassembly difficulties and increases the time and requirements for relamping. For example, as will be apparent from the embodiment of the invention disclosed herein, there may be twelve separate bolts which secure the lens to the lamp housing, and these bolts would have to be removed and replaced in accordance with prescribed procedures in order to change the lamp.

SUMMARY OF THE INVENTION

The present invention provides a-light fixture for use in hazardous locations or areas and employs a halogen lamp as the light source while facilitating lamp replacement. To facilitate replacement of the halogen lamp in an explosion-proof housing or electrical enclosure, a metal lampholder is mounted to an elongated carrier (thus forming a lamp carrier) which fits longitudinally through an opening of a metal shell forming the housing of the lamp. At one end of the lamp carrier there is an enlarged collar having an annular surface which cooperates with a mating annular ground surface on the housing to form a "ground surface" flame path.

The lamp carrier is secured to the housing by a threaded lock nut which also secures a bell-shaped metal end cap to the carrier when the lock nut is fastened to the metal housing. This arrangement closes the opening through which the lamp is removed for replacement without interrupting the main flame path of the housing (i.e., surrounding the face of the housing which mounts the lens).

The lamp carrier assembly is coupled to the housing by a tongue-in-groove structure. This permits the lamp carrier to be inserted or removed readily while preventing the lampholder from rotating when the lock nut is fastened to the housing, thus insuring correct location and orientation of the lamp in the housing while facilitating lamp replacement.

An electrical insert provides an electrical gland to isolate feed wires from the halogen lamp. The insert is enclosed by the lamp carrier and the metal end cap. Liquid seals are provided between the lamp carrier and the metal shell (i.e., housing), and between the bell-shaped end cap and the electrical insert providing electrical connections to the feed wires. Thus, relamping is accomplished simply by unscrewing the lock nut from the housing and extracting the lamp carrier from the light fixture housing. This completely removes the lamp from the light fixture for replacement while providing a flame path between the lamp carrier and the housing when the new lamp is inserted. The lamp carrier is reconnected to the light fixture housing simply by tightening the lock nut, which may be done by hand.

DETAILED DESCRIPTION OF THE PREFERRED EMBODIMENT

Figure 1:
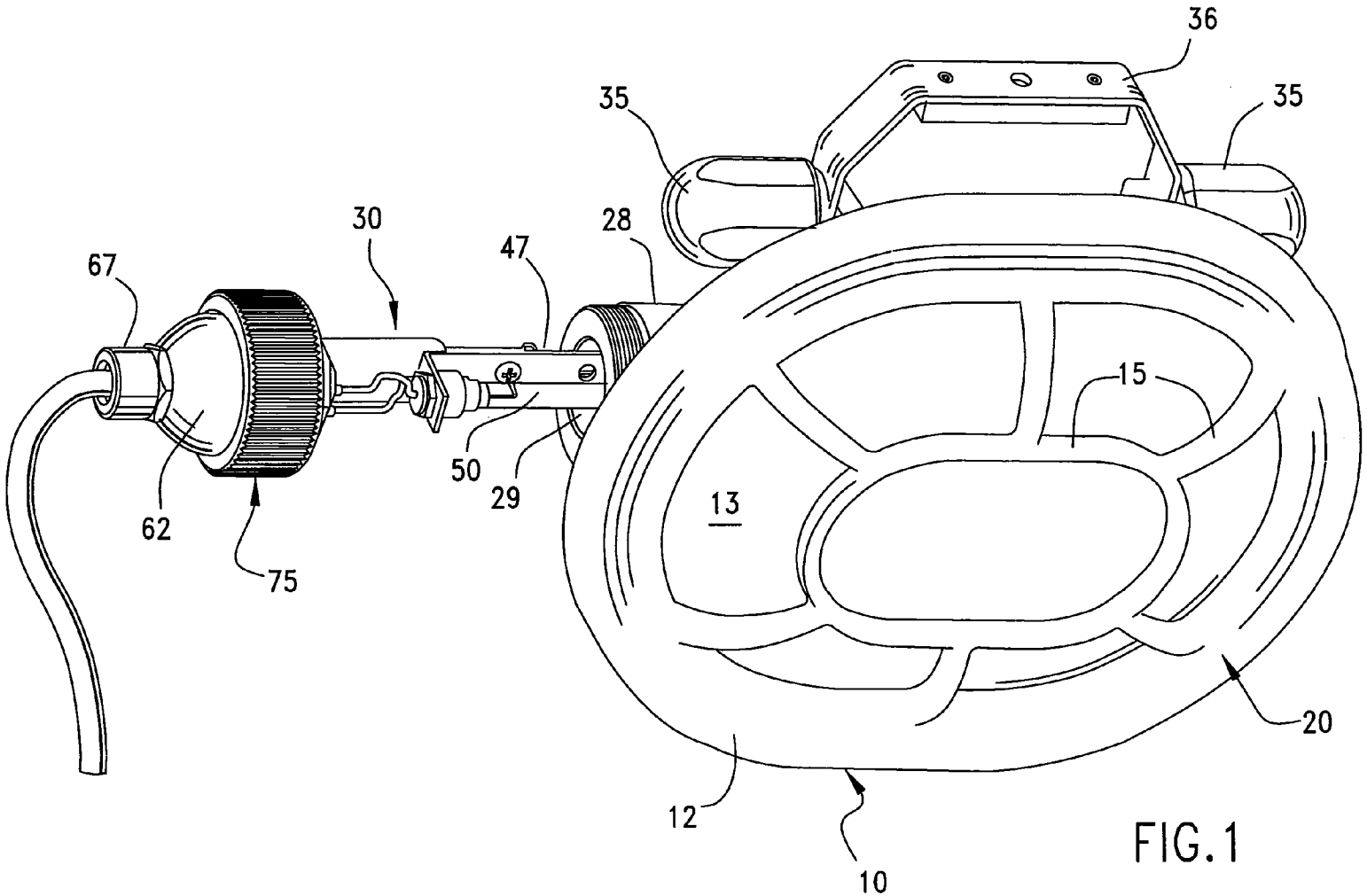
FIG. 1 is a perspective view of a light fixture constructed according to the present invention with the lamp-holder assembly partially removed from the housing, taken from an upper, frontal, left-side perspective.
Figure 2:
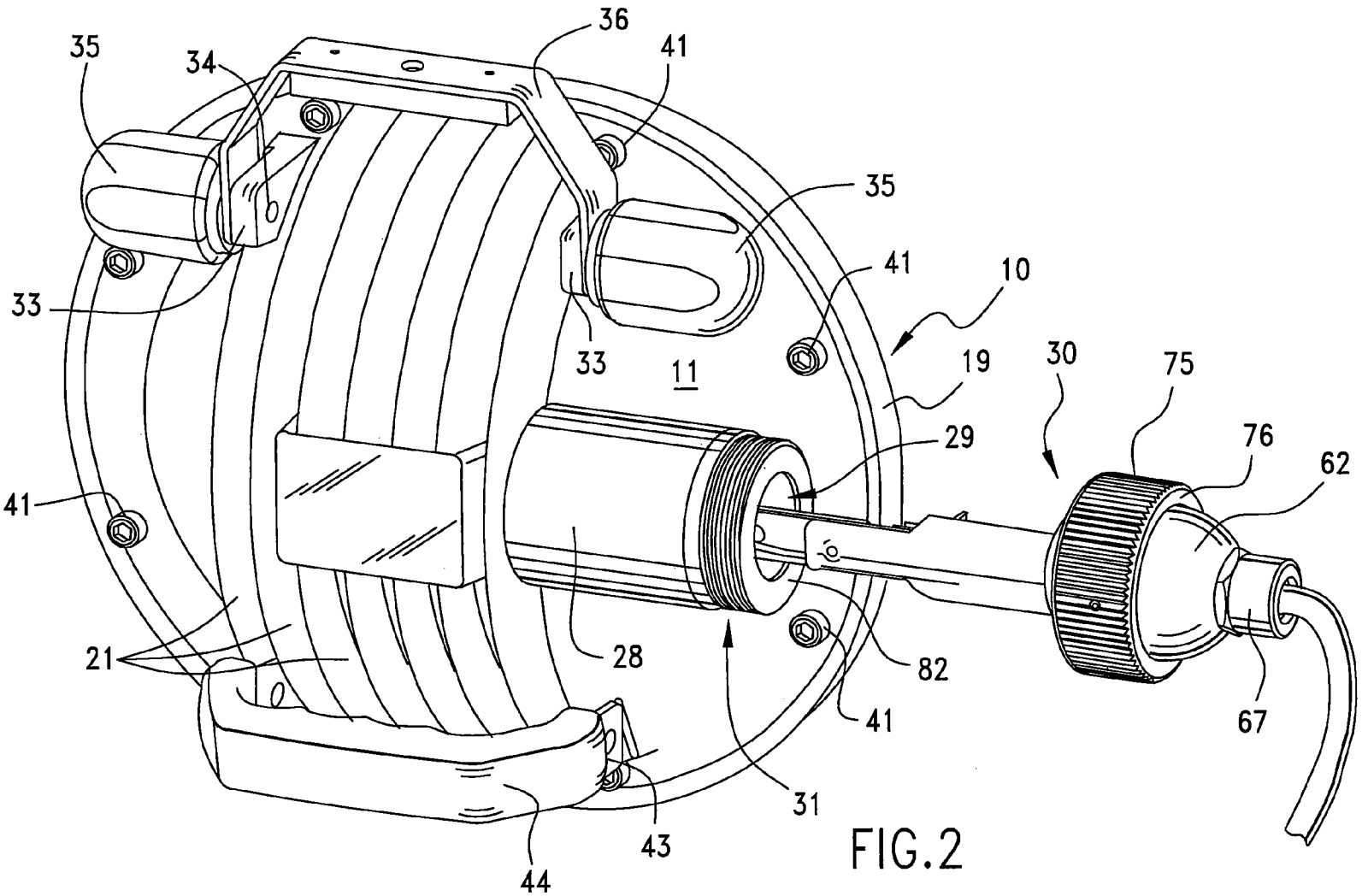
FIG. 2 is a perspective view of the light fixture as seen in FIG. 1 taken from the rear of the light fixture of FIG. 1, and from an upper, rear, side perspective.

Turning first to FIGS. 1 and 2, reference numeral 10 generally designates a light fixture and electrical enclosure embodying the present invention. The light fixture 10 includes a housing comprising a rear metal shell, generally designated 11 in FIG. 2, a front metal cover frame 12 (FIG. 1), and a glass lens 13 (FIGS. 1 and 3) which is shaped to conform to the protective gridwork generally designated 15 (FIG. 3) on the metal cover frame 12. The glass lens 13 preferably is made of high performance borosilicate glass, which tolerates large thermal fluctuations and sustains substantial impact without breaking or cracking.

The glass lens 13 has a generally flat flange 16 (FIG. 3) which has a general oblong-round shape extending about the perimeter of the lens, as illustrated, to form a compression seal with a peripheral flange of the shell 11, as will be further disclosed. The forward surface of the flange 16 of glass lens 13 is received in a recess formed in the rear portion of the border 19 of the metal cover frame 12, and the flange 16 of the glass lens 13, preferably lies flush against the corresponding rear surface on the border 19 of the frame 12. The front surface of the metal cover frame 12 preferably is covered with a synthetic cushioning material such as neoprene, designated 20, to cushion any inadvertent fall and prevent breakage of the lens 13.

Figure 3:
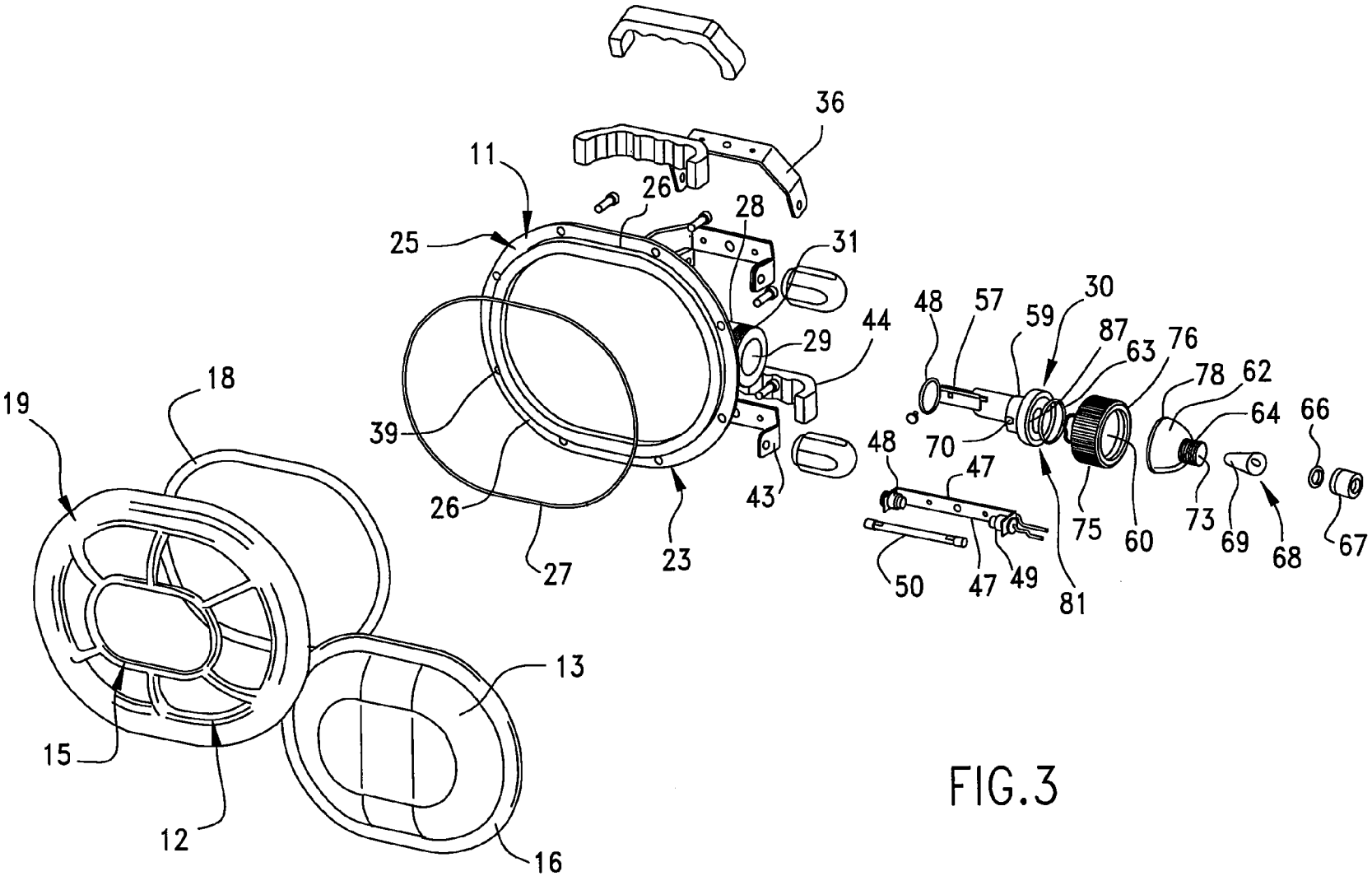
FIG. 3 is an upper, front and right side perspective view of the light fixture of FIGS. 1 and 2 with the components in exploded relation.

Turning now to FIGS. 2 and 3, the shell 11, seen best in FIG. 2, has a general dome or bowl shape with a lateral extension greater than the height so that its perimeter forms a corresponding shape to match the flange 16 of the glass lens 13. The metal shell 11 has a plurality of ribs 21 formed in large curved, raised structures extending from top to bottom across the rear surface of the shell 11. The ribs 21 add to the strength of the metal shell so that the shell is designed to be capable of resisting internal explosions, in cooperation with the high strength glass lens 13 and the metal cover frame 12. As will be appreciated from further disclosure, the metal shell 11, glass lens 13 and cover frame 12 cooperate to form a housing providing an electrical enclosure for the lamp, feed wires and electrical connections.

Turning now to FIG. 3, the forward edge of the shell 11 is formed into a flange 23 conforming to the obround shape of the flange 16 of the glass lens 13, as well as that of a flat metal ring 18. The front surface of the flange 23 of the shell 11 has a flat surface 25 which includes a groove 26 which extends circumferentially about the inner portion of the flange 23 and receives a sealing O-ring 27. The flat surface 25 of the flange 23 of the shell 11 and the opposing rear surface of the metal ring 18 are both ground (or otherwise machined) to conform to the NEC specifications for surfaces forming a "ground joint" flame path in accordance with NEC specifications and requirements.

Returning now to FIG. 2, integrally formed with the dome-like rear portion of the shell 11, is a cylindrical boss 28 defining a central opening 29 for receiving a lampholder or carrier assembly generally designated 30, and further described within. The boss 28 has a threaded end 31 for receiving a lock nut 75 which secures the lampholder assembly 30 to the boss 28 of the housing 11.

The lampholder 30 may be coupled to the boss 28 of the shell 11 by a tongue-in-groove assembly. The tongue may be on the inner surface of the central opening 29 and the matching groove on the base of the lampholder 30 so that the tongue is placed in the groove when the lampholder is properly oriented and slid longitudinally into the opening 29. This insures proper orientation of the lamp and permits the lock nut 75 (to be described further below) to be tightened to form the desired flame path without rotating the lamp carrier, as further described below.

Still referring to FIG. 2, in the upper, rear portion of the shell 11, there are formed a pair of spaced lugs 33 which are provided with internally threaded apertures such as the one designated 34 for receiving screws provided with internally threaded finger grips 35 to secure a mounting bracket 36 (see also FIG. 1) for mounting the light fixture on a tripod or other support structure so that it can be adjusted to a number of different angles or positions, providing flexibility in use.

In order to provide an explosion-proof electrical enclosure defined by the light fixture, a substantial number of threaded fasteners (see bolts 41 in FIG. 2) are used to secure the shell 11 to the metal cover frame 12. As many as eight or twelve threaded bores are formed in the rear surface of border 19 of cover frame 12. Threaded fasteners 41 extend through apertures, such as those shown at 39 in FIG. 3, formed in the flange 23 of the metal shell 11 and are received in threaded bores on the rear side of the border 19 of the cover frame 12, thus forming an explosion-proof electrical enclosure with a flame quenching path between the shell 11 and the cover frame 12 which receives and secures the explosion-proof glass lens 13.

With the large number of bolt-type fasteners securing the metal shell to the glass lens 13 and cover frame 12, it will be seen that it would be time consuming, and require hand tools, to change the halogen lamp within the explosion-proof enclosure.

Still referring to FIG. 2, if desired, a lower metal handle (see 43 in FIGS. 2 and 3), provided with a plastic overmold 44 may be secured to the rear surface of the shell 11 for carrying or adjusting.

Figure 5:
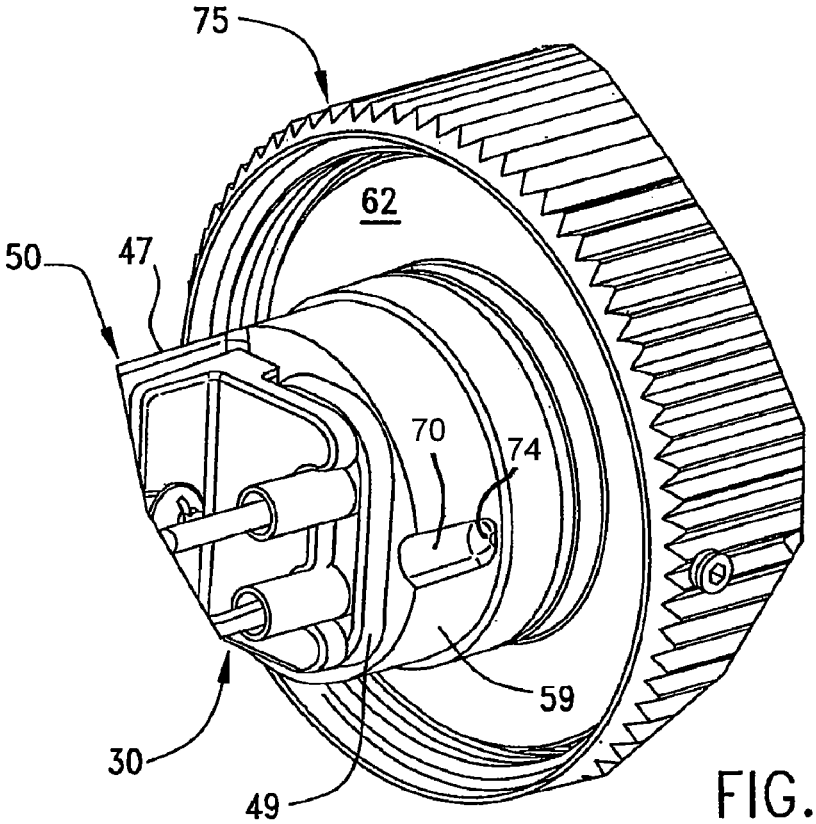
FIG. 5 is a close-up, fragmentary perspective view of the lampholder and threaded lock nut.

Turning now to FIGS. 3 and 5, the lamp-holder assembly 30 is shown with the principal components in exploded relation. The lamp-holder assembly 30 includes a metal bracket 47 with bent end tabs supporting first and second lamp sockets 48, 49 for mounting a halogen lamp 50.

The metal bracket 47 is secured to a base 57 by means of threaded fasteners or other mounting hardware. A housing 59 formed in the lamp-holder assembly receives an electrical insert 60 (FIG. 3). A bell-shaped end cap 62 is received over the insert 60 and sealed about the outer wall of the insert 60 by means of an O-ring 63.

The end cap 62 is provided with an extension 64 in the form of an externally threaded nipple for receiving electrical feed wires which can be connected to the insert 60 (FIG. 3), the lamp-holder assembly also includes wires for coupling the remote end of the insert 60 to the lamp sockets 48, 49 in a conventional manner.

A plastic washer 66 and internally threaded compression nut 67 are placed over the threaded nipple 64, with the feed wires running through the compression nut 67.

A sealing grommet 68 having an external surface 69, which is frusto-conical in shape (the inner, left side in FIG. 3 and of the external surface 69 being of a smaller radius) within a correspondingly shaped opening 73 of the nipple 64. Thus, when the feed wires are fed through the compression nut 67, washer 66, sealing grommet 68 and end cap 62, there is formed a strain-relief coupling for the feed wires.

Figure 4:
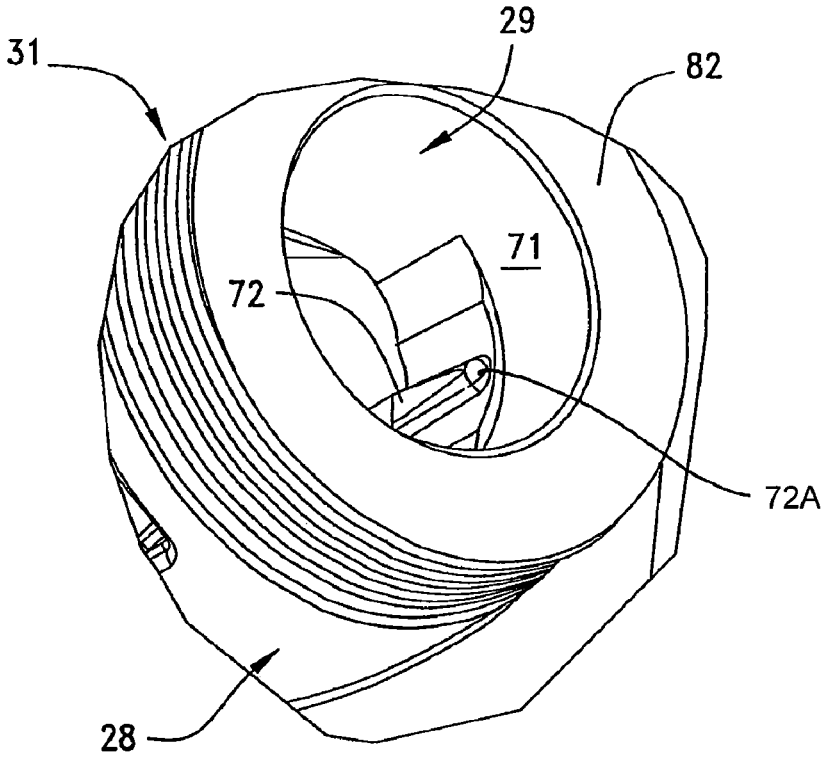
FIG. 4 is a close-up, fragmentary perspective view of the insertion boss showing a tongue or raised member for securing the lampholder.

The socket 49 is provided with an elongated, axially extending slot 70 which receives a corresponding raised rib or key 72 (FIG. 4) formed on the inner surface 71 (FIG. 1) of the cylindrical, externally threaded boss 28 of the shell 11. When the lamp-holder assembly 30 is slid into the opening 29 of the boss 28, the slot 70 on the lamp-holder housing 59 receives and engages the key 72 on the inner surface 71 of the opening 29 and fixes the position of the lamp-holder assembly 30 so that the lamp faces forward (that is, toward the center of the protective gridwork 15, and prevents rotation of the lamp). The internally threaded lock nut 75 is then placed over the end cap 62 and a circumferential flange 76 of the lock nut 75 engages the rear surface of a correspondingly dimensioned flange 78 (see FIG. 3) of the end cap 62, forcing the forward opening of the end cap 62 over the O-ring 63 to form a seal with the wires and the electrical insert. The slot 70 is provided with a limit surface 74 which engages the forward end 72A of the key 72 which locates and fixes the lampholder 30 in an axial direction of the boss 28. The forward opening of the end cap 62 engages a circumferential surface 81 of the boss 28 of the lamp-holder assembly 30 so that the electrical insert is sealed against water, the O-ring 63 forming a seal between the interior of the end cap 62 and the an outer surface of the electrical insert 60. This action also secures the lampholder.

When the lock nut 75 is secured onto the boss 28, the forward end of the end cap 62 (which comprises a ground surface) cooperates with a corresponding opposing ground surface 82 of the boss 28 of the shell 11, to form a second flame quenching path, thus permitting the lamp-holder assembly 30 to be safely removed to facilitate lamp replacement, while maintaining the requirements necessary for use in hazardous locations.

Having thus disclosed in detail an embodiment of the invention, persons skilled in the art will be able to modify the structure illustrated and substitute equivalent elements for those disclosed; and it is, therefore, intended that all such substitutions and equivalents be covered as they are embraced within the scope of the appended claims.

The invention claimed is:

1. A light fixture for use in a hazardous atmosphere comprising:

a housing including a metal shell, glass lens and a cover frame including protective gridwork providing an electrical, explosion-proof enclosure;

said shell and said cover frame constructed and arranged to provide a first quenching flame path;

said shell defining a boss having a cylindrical wall extending from said shell and defining a first circumferential ground surface surrounding an access opening;

a lampholder, including a mounting bracket;

a halogen lamp removably mounted to said mounting bracket;

electrical feed wires coupled to said lampholder;

an end cap receiving said wires and cooperating with said boss of said shell to enclose said lampholder assembly when placed through said boss into said housing, said end cap defining a second circumferential ground surface cooperating with said first circumferential ground surface when said end cap is assembled to said boss to form a second quenching flame path;

a threaded lock nut for securing said end cap and said lampholder assembly to said boss while permitting said lampholder assembly to be withdrawn from said housing through said boss as a unit when said lock nut is removed; and a positioning member in the form of an elongated raised member on one of an interior wall of said boss and said lampholder, and further including a recess in the other of said interior wall of said boss and said lampholder, said recess receiving said raised member when said lampholder is assembled to said shell, said raised member and said recess being constructed and arranged to limit the insertion and prevent rotation of said lampholder and position said lamp within said housing when said end cap is tightened on said boss.

2. The fixture of claim 1 wherein said positioning member engages the other of the lampholder and metal shell for positioning the lamp to a fixed, desired operating position when the lampholder assembly is inserted into the shell.

3. The fixture of claim 2 wherein said positioning member prevents rotation of said lampholder assembly about a longitudinal axis of said lampholder when said lampholder is in an operating position.

4. The fixture of claim 1 wherein said shell includes a forward facing ground surface, said fixture further including a flat metal ring having a shape conforming to said ground surface of said shell and cooperating with said forward facing ground surface of said shell to form said first quenching flame path.

5. The fixture of claim 1 wherein said boss is cylindrical and has an axis along which said lampholder may be removed, said lampholder being elongated and extending along an extension of said axis of said boss when said lampholder is assembled for use.

6. The apparatus of claim 1 wherein said elongated raised member and said recess form a tongue-in-groove, said raised member and said recess further cooperating to fix said lampholder in the direction of insertion when said lock nut is fastened onto said boss.

7. The fixture of claim 1 wherein said boss includes an aperture, said threaded lock nut permitting said lampholder assembly to be withdrawn from said housing through the aperture of said boss as a unit when said lock nut is removed without interruption of said first quenching flame path.

* * * * *